US011114262B2

(12) United States Patent
Sinjonia et al.

(10) Patent No.: US 11,114,262 B2
(45) Date of Patent: Sep. 7, 2021

(54) CONTACT SYSTEM FOR ELECTRICAL CURRENT CONDUCTION AND BUS TRANSFER SWITCHING IN A SWITCHGEAR

(71) Applicant: ABB Power Grids Switzerland AG, Baden (CH)

(72) Inventors: Manish Sinjonia, Vadodara (IN); Krunal Kansara, Vadodara (IN); Ajit Kadam, Pune (IN); Shashwat Chauhan, Ahmedabad (IN)

(73) Assignee: ABB Power Grids Switzerland AG, Baden (CH)

( * ) Notice: Subject to any disclaimer, the term of this patent is extended or adjusted under 35 U.S.C. 154(b) by 0 days.

(21) Appl. No.: 16/764,810

(22) PCT Filed: Jul. 13, 2018

(86) PCT No.: PCT/IB2018/055186
§ 371 (c)(1),
(2) Date: May 15, 2020

(87) PCT Pub. No.: WO2019/097314
PCT Pub. Date: May 23, 2019

(65) Prior Publication Data

US 2020/0365352 A1 Nov. 19, 2020

(30) Foreign Application Priority Data

Nov. 17, 2017 (IN) ..... 201741041220

(51) Int. Cl.
*H01H 1/44* (2006.01)
*H01H 31/20* (2006.01)
(Continued)

(52) U.S. Cl.
CPC ..... *H01H 33/12* (2013.01); *H01H 1/44* (2013.01); *H01H 31/20* (2013.01); *H01H 2031/286* (2013.01)

(58) Field of Classification Search
CPC ..... H01H 33/12; H01H 33/121; H01H 1/44; H01H 1/42; H01H 1/365; H01H 31/20;
(Continued)

(56) References Cited

U.S. PATENT DOCUMENTS 2,955,181 A * 10/1960 Luehring ..... H01H 33/126 218/10
3,134,865 A * 5/1964 Bernatt ..... H01H 31/20 200/48 SB (Continued)

OTHER PUBLICATIONS

International Search Report and Written Opinion of the International Searching Authority, PCT/IB2018/055186, dated Oct. 18, 2018, 12 pages.

*Primary Examiner* — William A Bolton
(74) *Attorney, Agent, or Firm* — Sage Patent Group

(57) ABSTRACT

A switchgear having bus transfer current switching capability by a turn and twist mechanism that includes a contact system for electrical current conduction and bus transfer switching is provided. The contact system has fixed and movable contact assemblies. Each contact assembly includes main contacts and arcing contacts. The arcing contacts are for bus transfer switching. The movable contact assembly includes a current path pipe and an end piece. The current path pipe is a cylindrical pipe, and the end piece is a rectangular block. The movable contact assembly includes a movable main contact provided on the rectangular block, and a movable arcing contact provided at the end of the cylindrical pipe on a portion about the periphery. During engagement, the cylindrical pipe turns about a first axis to bring the contact assemblies proximal to each other, and
(Continued)

twists about a second axis for engagement of the main contacts.

20 Claims, 12 Drawing Sheets

(51) Int. Cl.
*H01H 31/28* (2006.01)
*H01H 33/12* (2006.01)

(58) Field of Classification Search
CPC .. H01H 31/16; H01H 2031/286; H01H 31/28; H01H 31/26

USPC ..... 218/12, 11, 8, 7, 5, 4, 43; 200/16 F, 18, 200/48 CB, 48 SB, 48 KB, 48 A, 48 V, 200/48 R, 48 P
See application file for complete search history.

(56) References Cited

U.S. PATENT DOCUMENTS 3,206,581 A * 9/1965 Mikos ..... H01H 1/54 218/12
3,388,225 A * 6/1968 Foti ..... H01H 1/42 200/48 A
3,705,279 A * 12/1972 Kerr, Jr. ..... H01H 31/20 200/48 SB
4,110,579 A * 8/1978 Frink ..... H01H 3/30 218/12
4,112,268 A * 9/1978 Chung ..... H01H 31/20 200/48 SB
4,564,731 A 1/1986 Hartig
5,483,030 A * 1/1996 Bridges ..... H01H 33/126 200/48 KB
5,584,379 A * 12/1996 Bischoping ..... H01H 31/16 200/48 A
8,829,372 B1 9/2014 Rhein
9,147,537 B1 9/2015 Kowalik
2002/0092828 A1 7/2002 Demissy et al.
2017/0110273 A1* 4/2017 Rhein ..... H01H 31/26

* cited by examiner

CONTACT SYSTEM FOR ELECTRICAL CURRENT CONDUCTION AND BUS TRANSFER SWITCHING IN A SWITCHGEAR

CROSS REFERENCE TO RELATED APPLICATIONS

This application is a 35 U.S.C. § 371 national stage application of PCT International Application No. PCT/IB2018/055186 filed on Jul. 13, 2018, which in turns claims foreign priority to Indian Patent Application No. 201741041220, filed on Nov. 17, 2017, the disclosures and content of which are incorporated by reference herein in their entirety.

FIELD OF THE INVENTION

The present invention generally relates to switchgear having turn and twist mechanisms. More specifically, the present invention relates to a contact system for electrical current conduction and bus transfer switching in such switchgear.

BACKGROUND OF THE INVENTION

Switchgear such as disconnectors or isolators, have different configurations. One configuration of a switchgear is of a turn and twist type, wherein the switchgear comprises a turn and twist mechanism. Depending on the type of switchgear, there could be one or more than one fixed/movable contacts. For example, there can be a double break or a single break disconnector. In a side break configuration, a double break disconnector can have two movable contacts and two fixed contacts.

Such switchgear (e.g. disconnector) may be used for load transfer between buses (bus transfer). In such applications, the switchgear has the making/breaking capability, to handle the electrical/mechanical stresses involved in the bus transfer. Usually the switchgear contacts (fixed/moving) are designed to handle the electrical/mechanical stresses in the bus transfer. These contacts are typically the contact pins and/or the contact plate/fingers, either of which may be provided as a fixed or movable contact.

With increase in demand, high voltage switchgear (e.g. around 100 kV or above) for higher current ratings (e.g. around 2000 A, or more) are desired. It is required to support bus transfer switching at such ratings. Also, depending on the type, different making/breaking capabilities are required. As the rating increases, the switchgear contacts are exposed to higher wear and tear as a result of increase in the electrical/mechanical stresses. The existing switchgear contact systems are not suitable to handle such stresses.

In view of the above, there is a need for switchgear with improved contact systems for such higher ratings.

SUMMARY OF THE INVENTION

The present invention provides a switchgear having a turn and twist mechanism for electrical connection and disconnection. For example, the switchgear is a single break or double break disconnector. Taking another example, the switchgear can be a vertical break disconnector or isolator. In one embodiment, the switchgear is a double side break disconnector that has two fixed contacts and two movable contacts.

In accordance with various embodiments, the switchgear comprises a contact system for electrical current conduction and bus transfer switching. The contact system comprises at least one fixed contact assembly, and at least one movable contact assembly. For example, if the switchgear of single break type, then it has one fixed contact assembly and one movable contact assembly. Similarly, if the switchgear is of double break type, then it can have two fixed contact assemblies and two movable contact assemblies (depending on whether it is a center break or a side break type).

The fixed contact assembly of the switchgear comprises a fixed main contact and a fixed arcing contact. The fixed main contact is for electrical current conduction, and comprises contact fingers. In one embodiment, the fixed main contact has a first set and a second set of contact fingers. Here, the two sets are parallel to each other and are positioned to interface with corresponding contacting elements of the movable contact assembly. The number of contact fingers in each set can be determined based on the rating of the switchgear.

The fixed arcing contact is provided for bus transfer switching. The fixed arcing contact is a finger comprising a contacting element for engaging with a corresponding contacting element of a movable arcing contact of the contact system during bus transfer switching. In the embodiment where the fixed main contact comprises the two sets of contact fingers, the arcing contact is located proximal to a first set of contact fingers. In accordance with the embodiment, the separation between the two sets of contact fingers is less than the separation between the arcing contact and the second set of contact fingers. Further, the contacting element of the fixed arcing contact is provided on a portion of the finger that is at an angle to the contact fingers.

The movable contact assembly comprises a current path pipe and an end piece. In accordance with various embodiments, the current path pipe is a cylindrical pipe and the end piece is a rectangular block. In an embodiment, the length or breadth of the end piece is less than the diameter of the current path pipe. The rectangular block is attached at an end of the cylindrical pipe. For example, the rectangular block can be welded at a flange provided at the end of the cylindrical pipe.

The movable contact assembly comprises a movable main contact and the movable arcing contact. The movable main contact is for engaging with the fixed main contact (i.e. the contact fingers) for electrical current conduction, and the movable arcing contact is for bus transfer switching. The movable main contact is provided on the rectangular block, and the movable arcing contact is provided at the end of the cylindrical pipe on a portion about the periphery of the cylindrical pipe.

In an embodiment, the movable main contact comprises two u-shaped contacting elements attached with the rectangular block, wherein each u-shaped contacting element is provided for engagement with a corresponding set of contact fingers. In one embodiment, the movable arcing contact is positioned such that a portion of the movable arcing contact protrudes at the portion of about the periphery of the cylinder. Further, the movable arcing contact is attached with the cylindrical pipe, at a portion of the movable arcing contact that is within the periphery of the cylindrical pipe.

During engagement of the movable contact assembly with the fixed contact assembly, the cylindrical pipe turns and twists. The cylindrical pipe turns about a first axis (e.g. vertical axis of an isolator passing through the center of the cylinder) to bring the movable contact assembly proximal to the fixed contact assembly. In an embodiment, the fixed contact assembly also comprises a mechanical stopper for stopping the turning movement of the current path pipe. In accordance with the embodiment, the cylindrical pipe turns till it touches the mechanical stopper, post which the twisting happens.

The cylindrical pipe twists about a second axis (e.g. axis of the cylindrical pipe) for engagement of the movable main contact with the fixed main contact. In accordance with an embodiment, the cylindrical pipe twists till the stopper bolt is parallel to a plate of the fixed contact assembly.

During the engagement of the movable and fixed contact assembly, the arcing contacts for bus transfer switching are the first contacts to engage, and the main contacts engage subsequently as the arcing contacts begin to disengage. By the time the main contacts are fully engaged, the arcing contacts are disengaged. It would be apparent that during disengagement, the main contacts disengage first, and the arcing contacts are the last contacts to disengage.

The movable contact assembly can also have a stopper bolt. The stopper bolt can be attached with the rectangular block for preventing separation of the contact fingers of the fixed contact assembly from the main contacts the moving contact assembly during short circuit condition.

BRIEF DESCRIPTION OF DRAWINGS

The subject matter of the invention will be explained in more detail in the following text with reference to exemplary embodiments which are illustrated in attached drawings in which.

DETAILED DESCRIPTION

The present invention provides a switchgear with a turn and twist mechanism. The switchgear of the invention has a contact system having contacts for bus transfer switching.

Figure 1A:
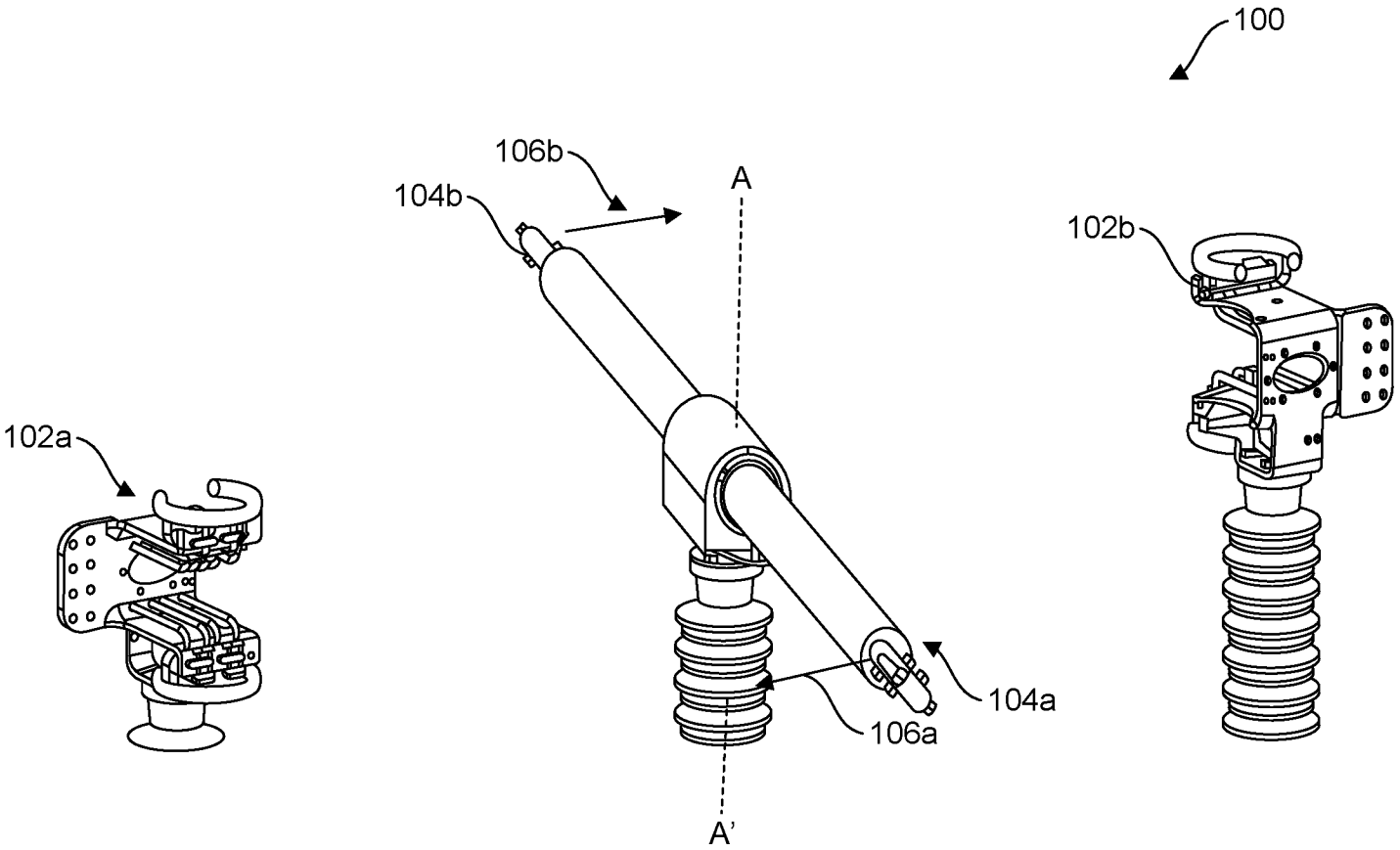
FIGS. 1A and 1B show perspective views of a switchgear having a turn and twist mechanism, in accordance with an embodiment of the invention.
Figure 1B:
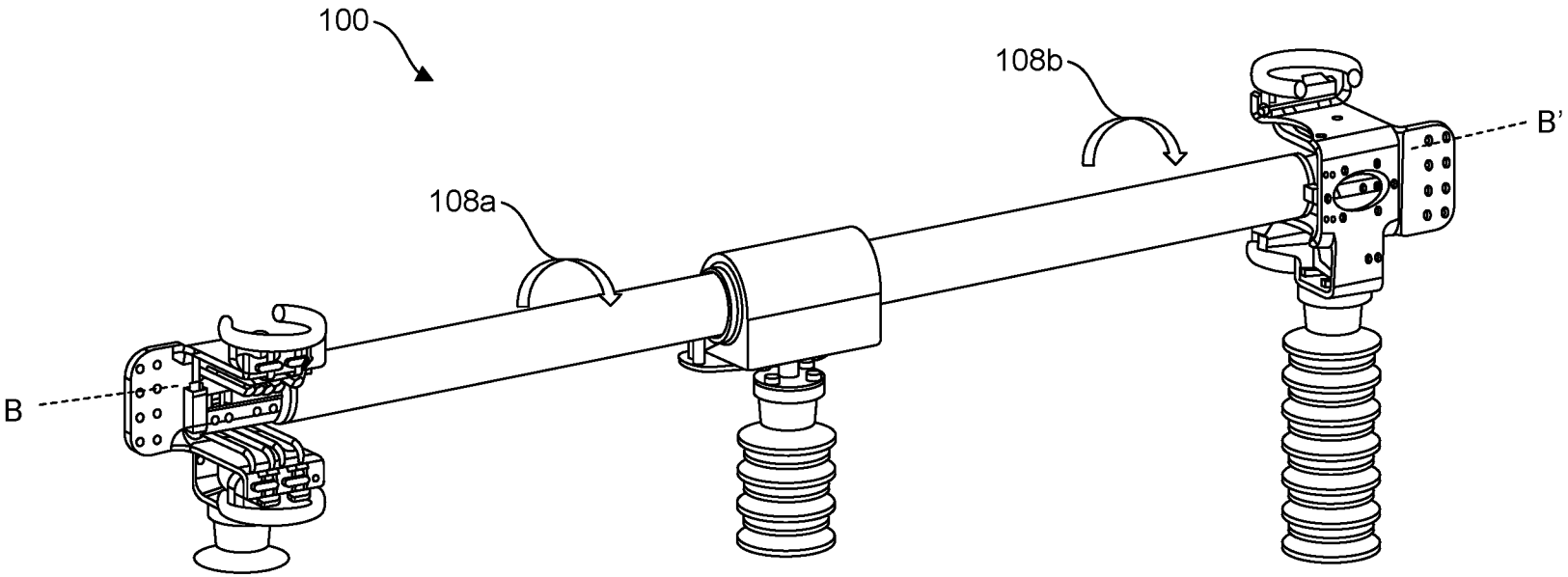

FIGS. 1A and 1B show an embodiment wherein the switchgear is a disconnector (100). In accordance with the embodiment, the disconnector is a double side break disconnector. In FIG. 1A, the disconnector is in an open position, from which it can turn to a position for closing as shown in FIG. 1B. In the embodiment of FIGS. 1A and 1B, the disconnector has two fixed contacts (102*a*, 102*b*) and two movable contacts (104*a*, 104*b*).

Figure 2A:
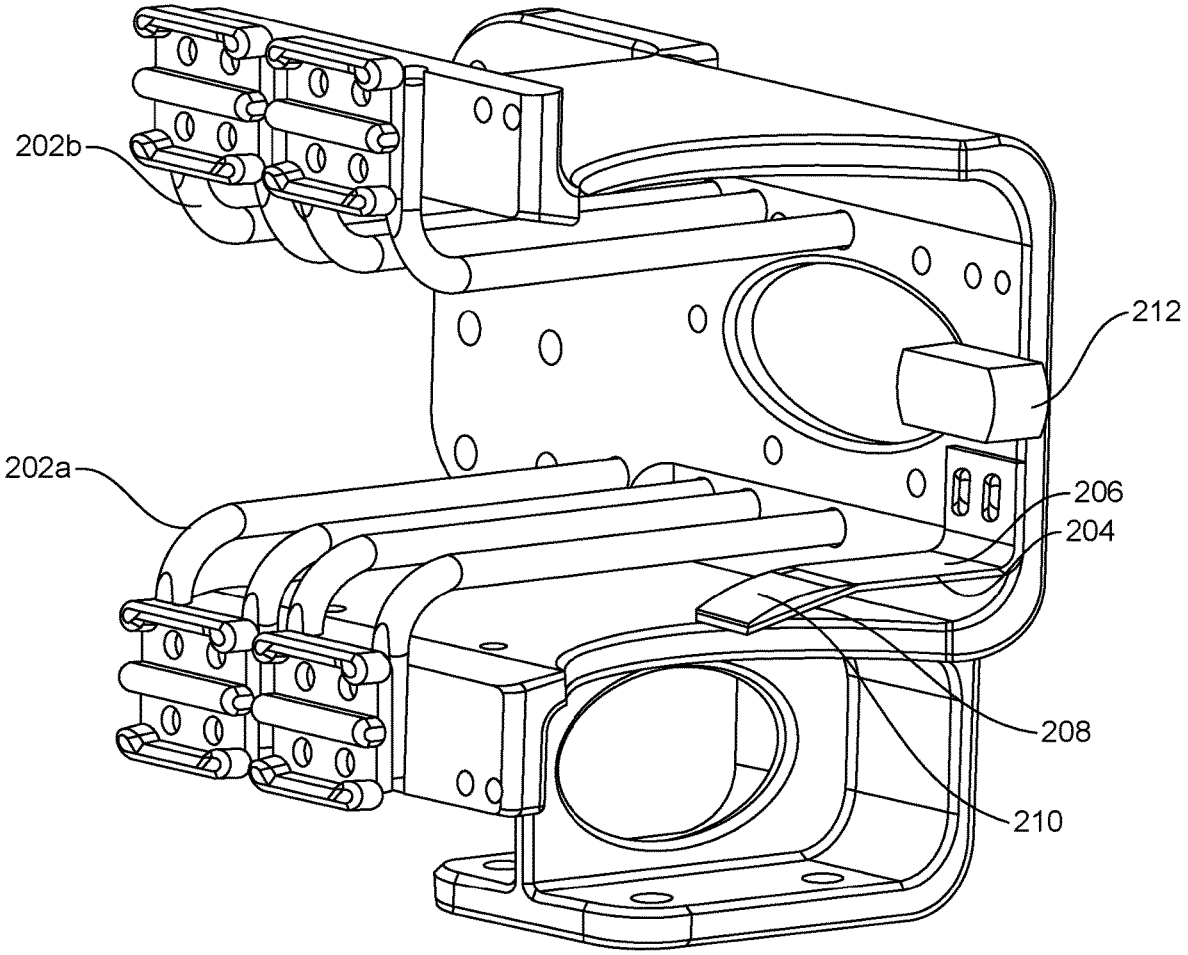
FIGS. 2A and 2B show a perspective view of a fixed contact assembly of the switchgear, in accordance with an embodiment of the invention.
Figure 2B:
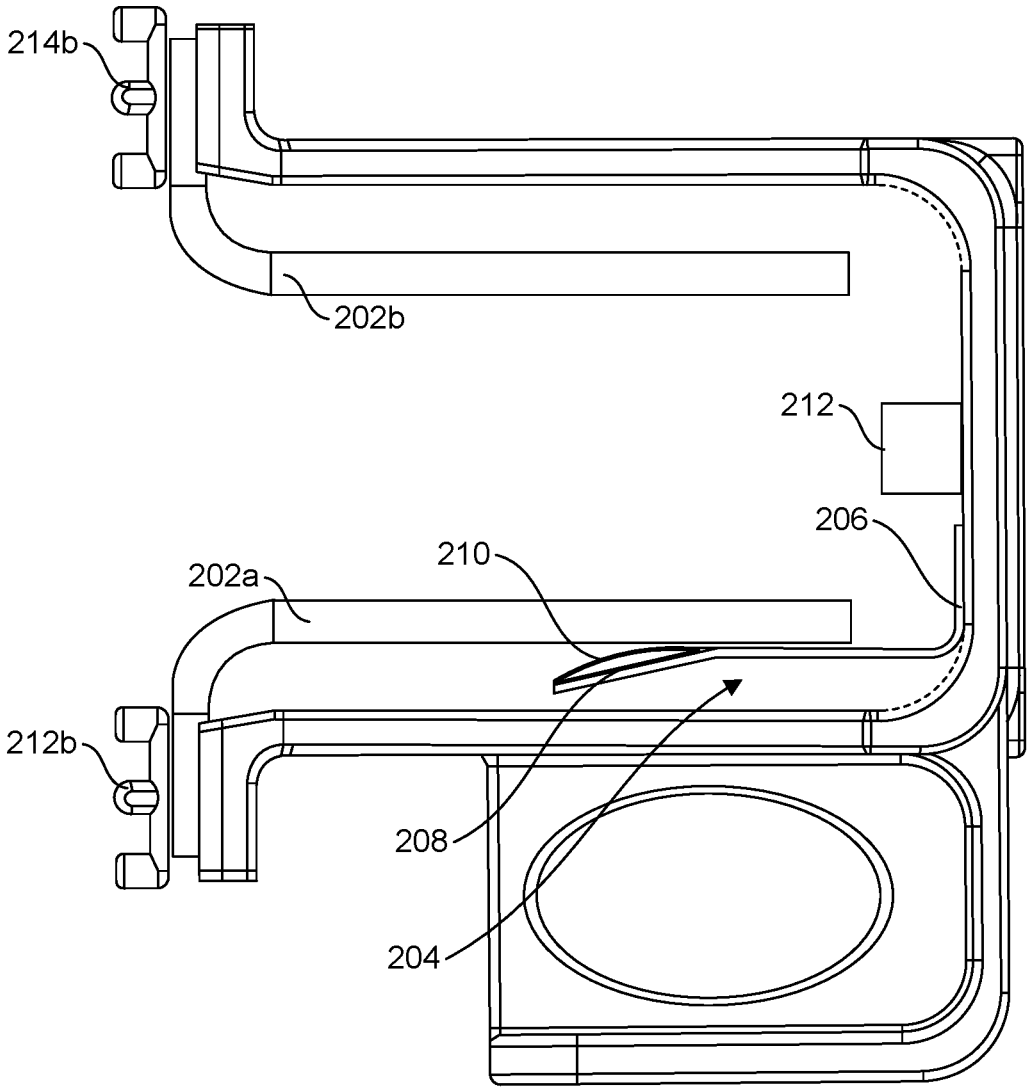

FIGS. 2A and 2B show a fixed contact assembly of the switchgear, in accordance with an embodiment of the invention. As shown, the fixed contact assembly has a fixed main contact (primary contact) and a fixed arcing contact (also referred herein as auxiliary contact). The main and arcing contact are attached with a casting as shown in FIGS. 2A and 2B. In the embodiment, the main contact comprises a first set (202*a*) and a second set (202*b*) of main contact fingers. As shown, each set of contact fingers can have multiple contact fingers that are of similar size and shape, and are positioned in parallel to each other. In the embodiment of FIGS. 2A and 2B, each contact finger is L-shaped and attached with the plate at one end (214*a*, 214*b*) as shown in FIG. 2B such that the contact fingers in the corresponding set are parallel to each other. The number of contact fingers in each set can be determined based on the rating of the switchgear.

Figure 3:
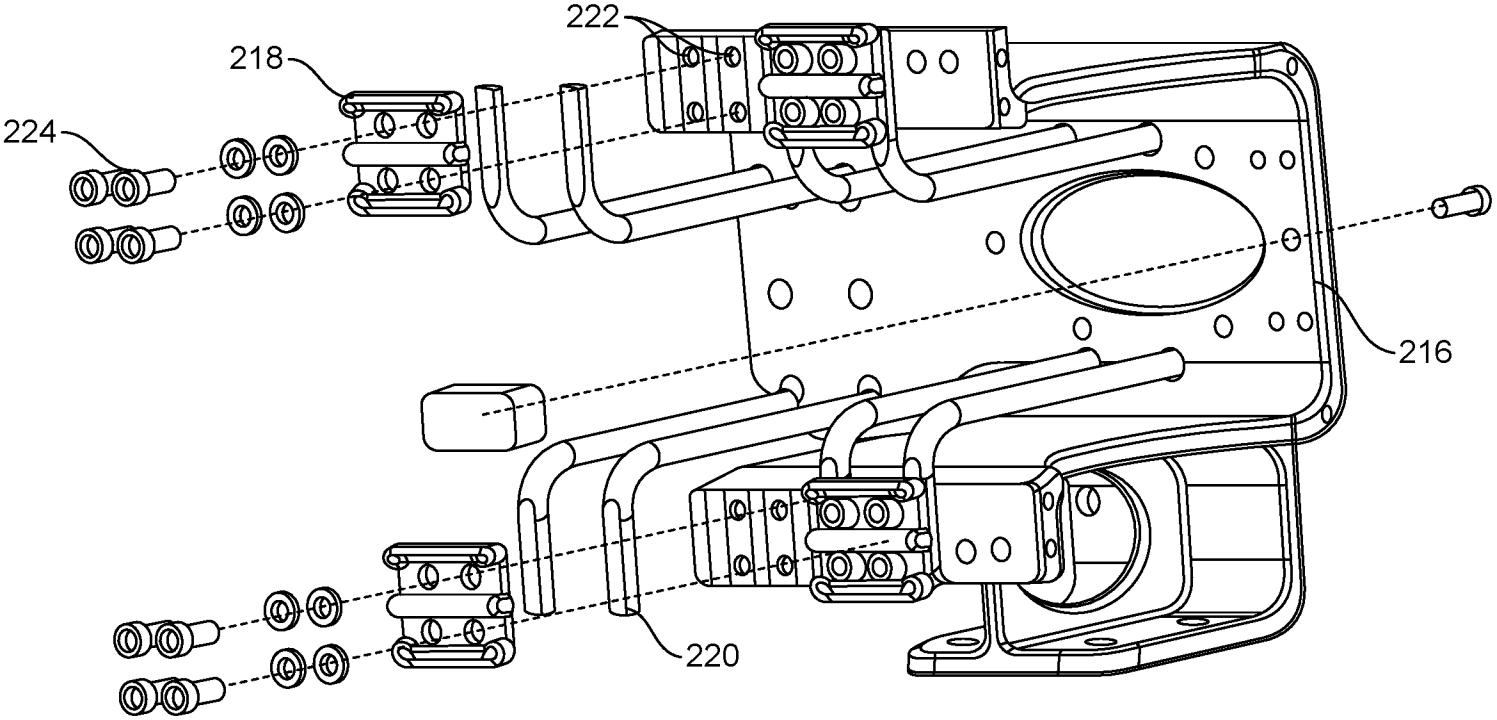
FIG. 3 shows an exploded view of the fixed contact assembly of the switchgear, in accordance with an embodiment of the invention.

As shown in the exploded view in FIG. 3, the contact fingers (of 202*a*, 202*b*) are attached with the casting (216), using finger holders (218). Each contact finger comprises a flat surface (220). The flat surface provides for locking of rotation of the contact fingers due to electrical/mechanical forces (e.g. forces faced during switching (turning/twisting)). Slots (such as 222) are provided on the casting to accommodate the fingers perpendicularly. Due to the perpendicular mounting option provided by the slots and shape of the fingers, the fingers can be moved up and down relative to the casting (e.g. for fixing the distance between the contact fingers of the two sets). Thus, as per the contact forces required for the disconnector, the gap between the contact fingers (sets) can be adjusted. This is helpful, especially if it is desired to adjust the gap between the fingers after manufacturing (e.g. during assembly at field location).

The arcing contact (204), as shown in FIG. 2, is a contact finger for bus transfer switching. In accordance with the embodiment, the arcing contact is proximal to the first set of contact fingers (202*a*). Further, the arcing contact is positioned slightly lower than the first set of contact fingers for corresponding engagement with a movable arcing contact.

In accordance with the embodiment shown in FIG. 2, the arcing contact is substantially flat, with a first portion (206) of the contact being parallel to the main contact fingers, and a second portion (208) of the contact being at an angle to the first portion. It will be apparent that the contact finger is bent at a line, making the two flat surfaces at an angle to each other. The arcing contact has a contacting element (210) on the second portion, for engaging with a movable arcing contact. Thus, the arcing contact acts as a leaf spring and a current carrying system.

In the embodiment shown in FIG. 2, the fixed contact assembly also comprises a mechanical stopper (212). The stopper is for stopping the turning movement of the movable contact assembly (as described hereinafter).

Figure 4:
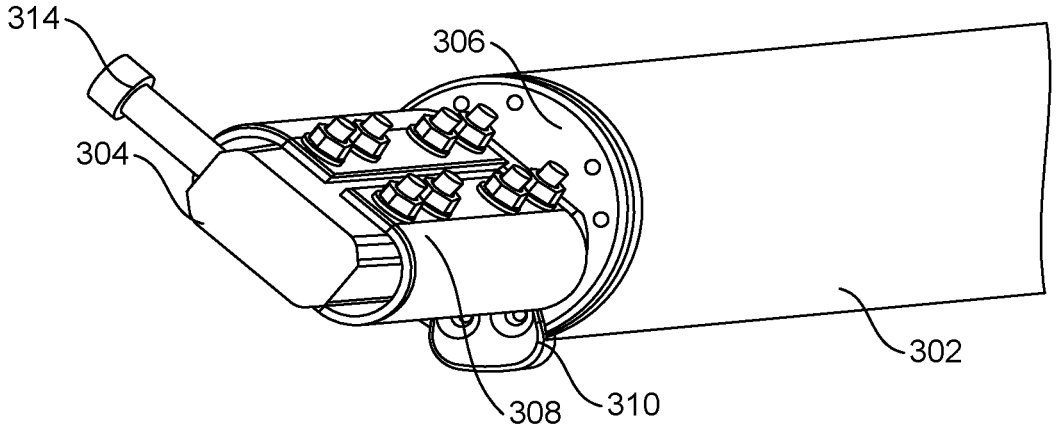
FIGS. 4-6 show perspective views of a movable contact assembly of the switchgear, in accordance with an embodiment of the invention.
Figure 5:
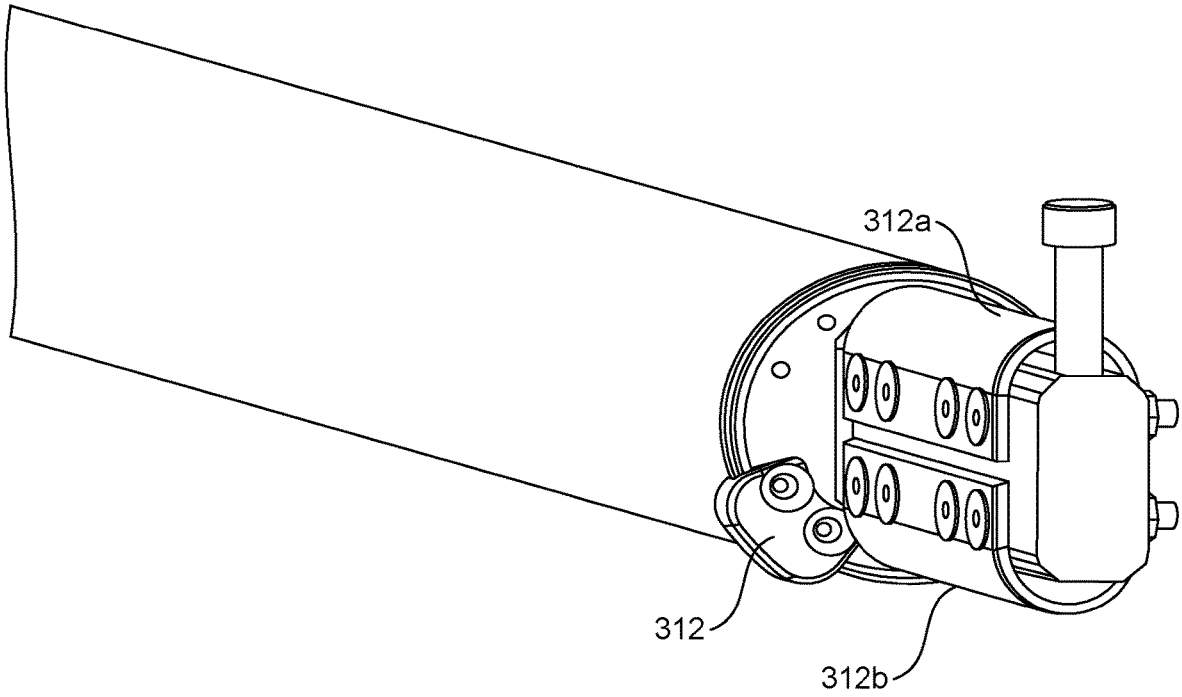
Figure 6:
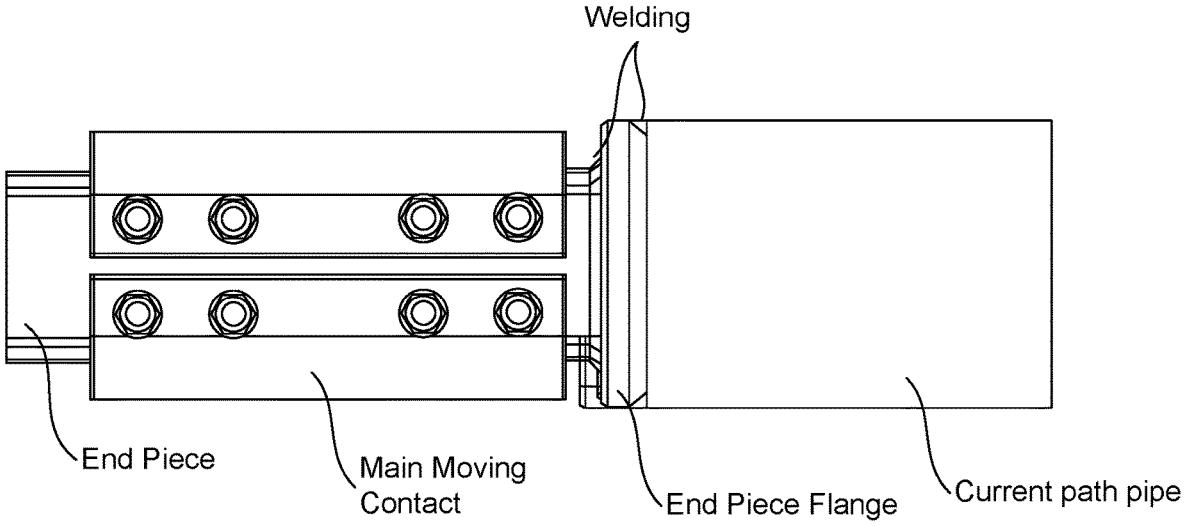

FIGS. 4-6 show a movable contact assembly of the switchgear, in accordance with an embodiment of the invention. The movable contact assembly comprises a current path pipe (302) and an end piece (304). As shown, the current path pipe is a cylindrical pipe and the end piece is a rectangular block. Further as shown, dimensions (length, breadth) of the rectangular block are less than diameter of the cylindrical pipe. Here, the rectangular block is attached with the cylindrical pipe at an end. In accordance with the embodiment, as highlighted in FIG. 6, the rectangular block is attached (e.g. welded) at the end of the cylindrical pipe with a flange (306) of the rectangular block.

The movable contact assembly comprises a movable main contact (308) and the movable arcing contact (310). The movable main contact can be a single contact or a contact with two or more contacting elements. In the embodiment of FIGS. 4 and 5, the main contact (or primary contact) comprises two u-shaped contacting elements (312*a*, 312*b*) provided on the rectangular block as shown. Further, as shown, the movable arcing contact is provided at the end of the cylindrical pipe. Here, the arcing contact is provided on a portion (312) about the periphery (peripheral portion) of the cylindrical pipe.

As shown in FIGS. 4 and 5, in accordance with the embodiment, the movable arcing contact is positioned such that a portion of the movable arcing contact protrudes at the portion of about the periphery of the cylinder. Further as shown, the movable arcing contact is attached with the cylindrical pipe, at a portion of the movable arcing contact that is within the periphery of the cylindrical pipe. The movable arcing contact is provided such that at the end of the turning movement of the movable contact assembly, initially the arcing contacts (of fixed/movable contact assembly) engage, after which commutation happens, in which the arcing contacts gradually disengage and the primary contacts engage.

The movable contact assembly can rotate about two axes. Referring to FIGS. 1A and 1B, the cylindrical pipe can rotate or turn (106*a*, 106*b*) about a first axis (AA'), and twist (108*a*, 108*b*) about a second axis (BB'). As shown in FIG. 1A, the first axis is a vertical axis (e.g. axis of the insulator), about which the cylindrical pipe can rotate to move the movable contact assembly (or assemblies). Further, as shown in FIG. 1B, the second axis is a horizontal axis (e.g. the axis of the cylindrical pipe), about which the pipe can rotate (or twist) to move the movable contact assembly (or assemblies) relative to the fixed contact assembly (or assemblies). In the embodiment shown in FIGS. 4 and 5, the movable contact assembly comprises a stopper bolt (314). The stopper bolt can be attached with the rectangular block for preventing separation of the contact fingers of the fixed contact assembly from the main contacts of the moving contact assembly during short circuit condition. In accordance with an embodiment, the cylindrical pipe twists till the stopper bolt is parallel to a plate (e.g. of casting) of the fixed contact assembly.

Figure 7:
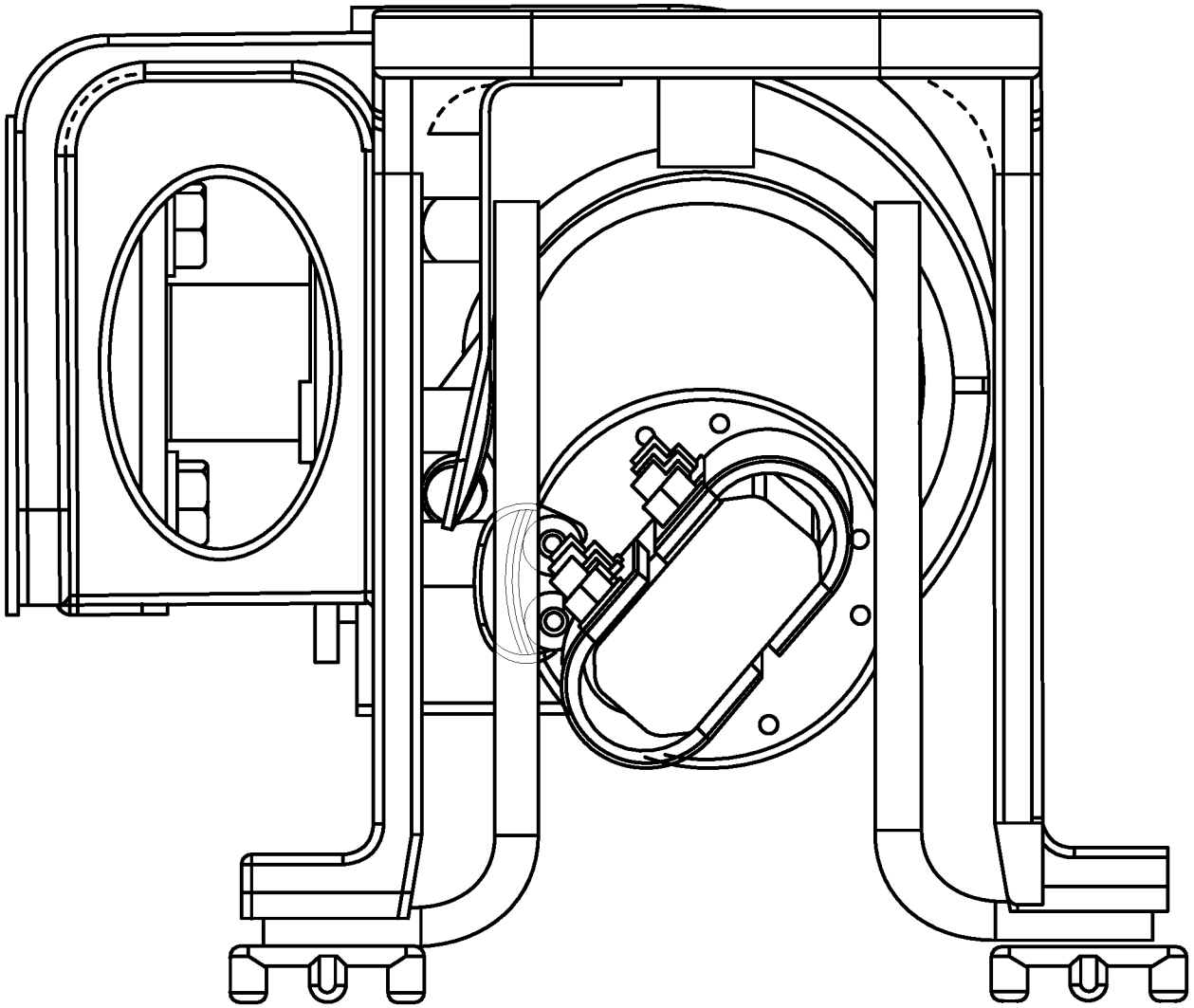
FIGS. 7-10 show different side views during engagement of the movable and fixed contact assemblies during switching, in accordance with an embodiment.

Turing the movable contact assembly results in the movable contact assembly to come to a position as shown in FIG. 7. During closing, the current path enters the fixed contact assembly at an angle (e.g. around 50° w.r.t vertical). The angle of current path is set in such way that sufficient clearance is maintained between the primary contacts to prevent arcing between the primary contacts during closing.

Figure 8:
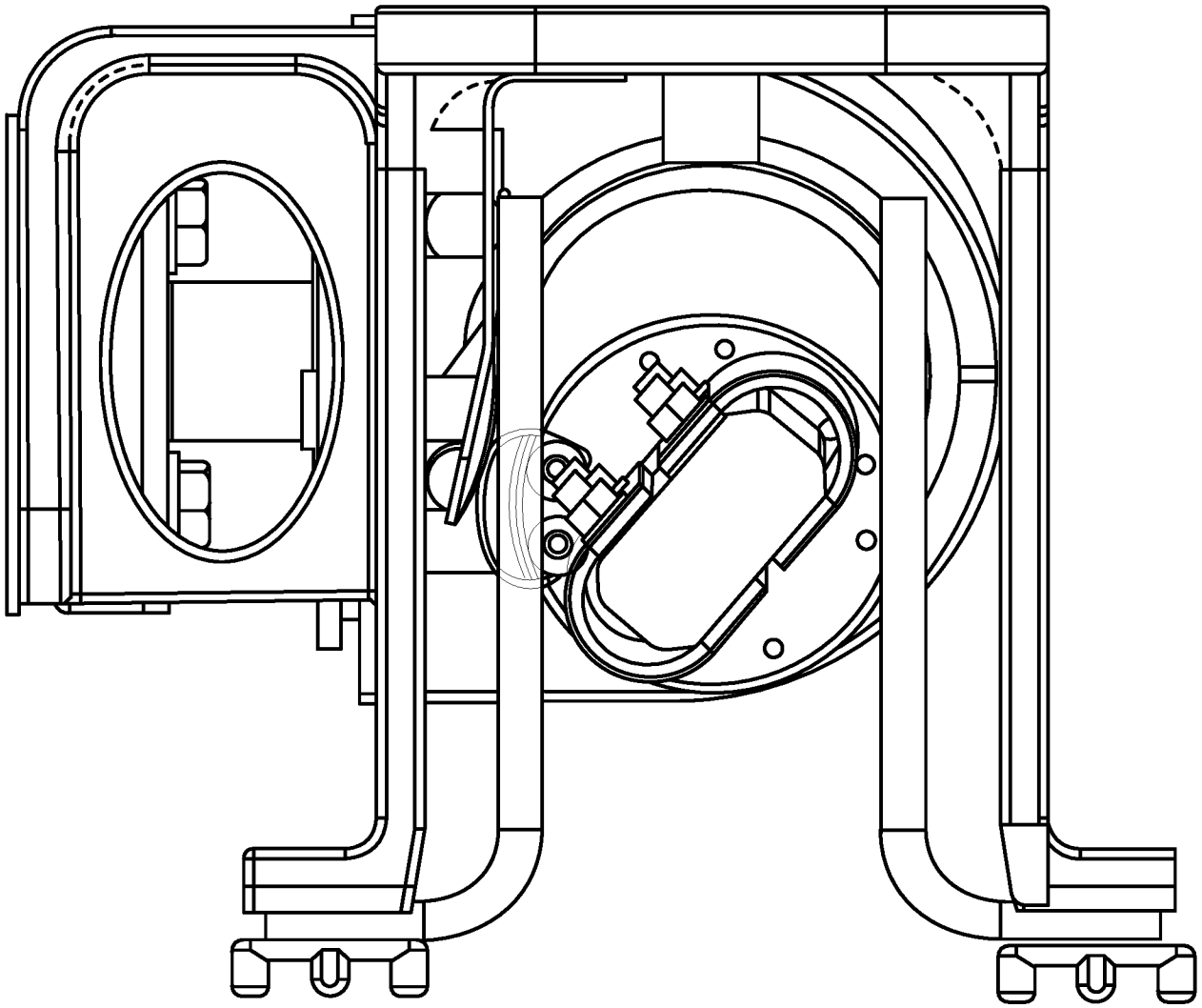

The current path pipe turns till the pipe touches the stopper. FIG. 8 shows the position of the contacts just before twisting. Thus, when the current path further moves inside the fixed contact, the arcing contacts first touch each other and arcing occurs only between the arcing contacts.

Figure 9:
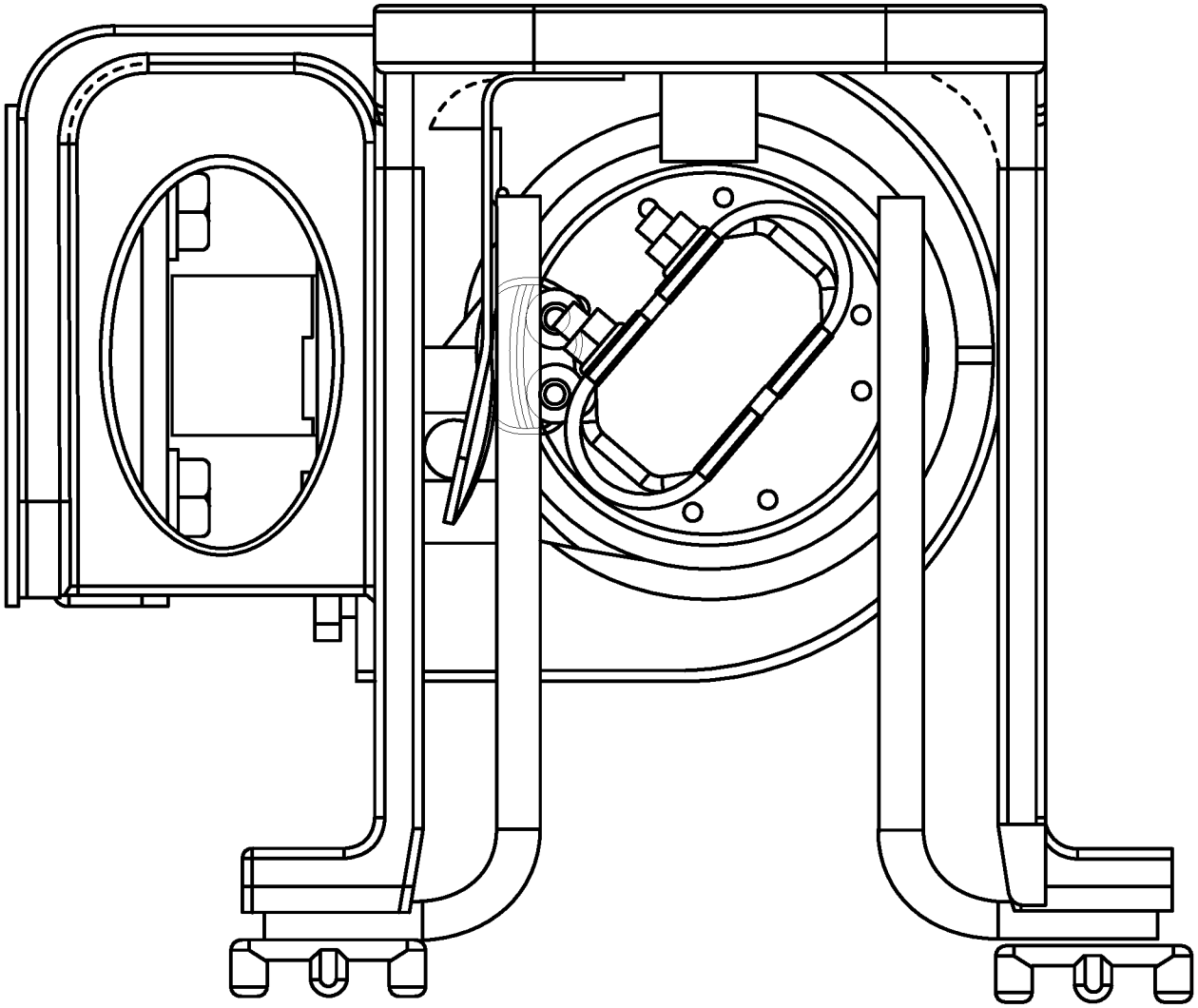

FIG. 9 shows the position of the contacts during commutation. When the current path touches the stopper (212, FIGS. 2A and 2B), it starts twisting. During this stage, the arcing contacts are gradually disengaging and the primary contacts are gradually engaging. The contacts are designed in such a way that there is sufficient overlap of contacts for smooth switching of current from arcing contacts to primary contacts.

Figure 10:
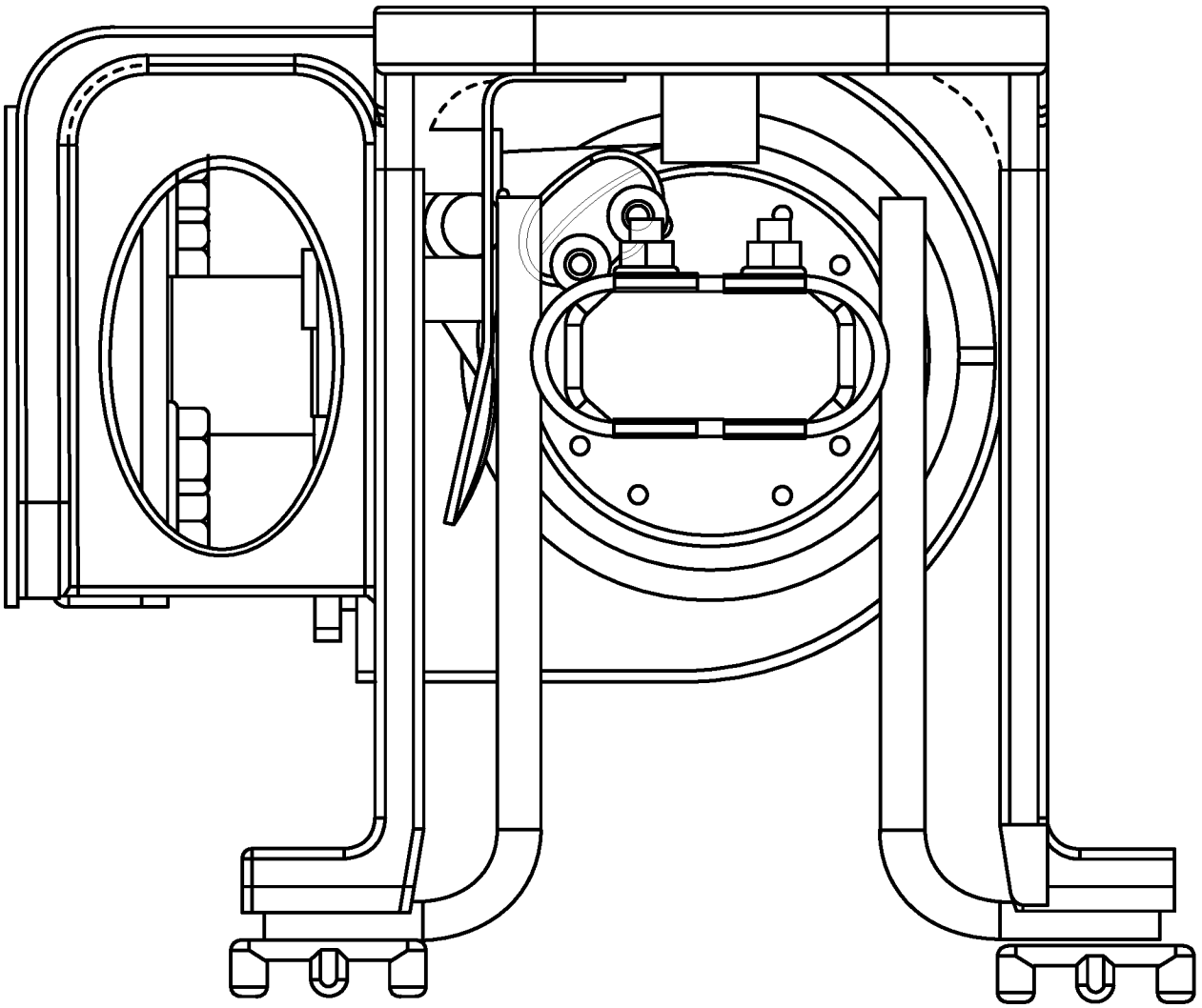

FIG. 10 shows the position of the contacts in full close condition. When the current path fully twists, the switchgear comes to full close condition. In an embodiment, the current path twists by 50° for the switchgear to come to a full close condition. In the full close condition, the arcing contacts completely disengage and the primary contacts engage completely as shown. In this position, the rated current flows only from the primary contacts Thus, the contacts for bus transfer switching (BTS contacts) serve the purpose of arcing contacts. The BTS contacts disengage when the switchgear is in full close condition, and thus rated current flows only through the primary contacts. The BTS contacts are made using a special material to minimize the arc erosion and welding b/w BTS contacts. In an embodiment, the BTS contacts are made from copper/tungsten material.

The BTS contacts are designed in such a way that twisting of current path breaks any welding between the BTS contacts that may occur due to arcing. Additionally, the design of the BTS contacts is such that contact force between the BTS contacts increases as current path twists, thus preventing any possibility of arcing between the primary contacts. Also during commutation (point where contact shifts from the auxiliary contacts to main contacts), contact resistance is low (thanks to good contact force generated because of spring properties of auxiliary flat contact), which result in smooth transfer from auxiliary contact to main contact without arching both during opening and closing operation. Spring action on flat contact ensures contact all time even with some contact erosion that may occur.

We claim:

1. A switchgear having a turn and twist mechanism for electrical connection and disconnection, the switchgear comprising a contact system for electrical current conduction and bus transfer switching, the contact system comprising:

at least one fixed contact assembly, comprising a fixed main contact and a fixed arcing contact, wherein the fixed arcing contact is provided for bus transfer switching, and wherein the fixed arcing contact is a finger comprising a contacting element for engaging with a corresponding contacting element of a movable arcing contact of the contact system during the bus transfer switching; and at least one movable contact assembly comprising a current path pipe and an end piece, wherein the current path pipe is a cylindrical pipe and the end piece is a rectangular block attached at an end of the cylindrical pipe, wherein the at least one movable contact assembly comprises a movable main contact and the movable arcing contact, wherein the movable main contact is for engaging with the fixed main contact for current conduction, and the movable arcing contact is for the bus transfer switching, wherein the movable main contact is provided on the rectangular block, and the movable arcing contact is provided at the end of the cylindrical pipe on a portion about a periphery of the cylindrical pipe, wherein during engagement of the at least one movable contact assembly with the at least one fixed contact assembly, the cylindrical pipe turns about a first axis to bring the at least one movable contact assembly proximal to the fixed contact assembly, and then twists about a second axis for engagement of the movable main contact with the fixed main contact, wherein during the engagement of the at least one movable contact assembly and the fixed contact assembly, the fixed arcing contact and the movable arcing contact for the bus transfer switching are contacts that are first to engage and are disengaged when the movable main contact and the fixed main contact are engaged.

2. The switchgear of claim 1, wherein the fixed main contact comprises a first set of contact fingers and a second set of contact fingers, wherein the fixed arcing contact is located proximal to the first set of contact fingers, and wherein a separation between the first set of contact fingers and the second set of contact fingers is less than a separation between the fixed arcing contact and the second set of contact fingers.

3. The switchgear of claim 2, wherein the contacting element of the fixed arcing contact is provided on a portion of a finger that is at an angle to the first set of contact fingers.

4. The switchgear of claim 2, wherein the movable main contact comprises two c-shaped contacting elements attached with the rectangular block, wherein each c-shaped contacting element is provided for engagement with a corresponding set of contact fingers.

5. The switchgear of claim 1, wherein the fixed contact assembly further comprises a mechanical stopper for stopping a turning movement of the current path pipe.

6. The switchgear of claim 1, wherein the movable contact assembly further comprises a stopper bolt attached with the rectangular block, for preventing a separation of the finger of the fixed contact assembly from the main movable contact of the at least one movable contact assembly during short circuit condition.

7. The switchgear of claim 1, wherein a length and breadth of the end piece is less than a diameter of the current path pipe.

8. The switchgear of claim 1, wherein the switchgear is a double side break disconnector with two movable contacts and two fixed contacts.

9. A contact system for a switchgear, comprising:

a fixed contact assembly including a fixed main contact and a fixed arcing contact for bus transfer switching, wherein the fixed arcing contact comprises a finger including a contacting element for engaging with a corresponding contacting element of a movable arcing contact of a movable contact assembly of the contact system during the bus transfer switching; and the movable contact assembly comprising a current path pipe and an end piece, wherein the current path pipe comprises a cylindrical pipe and the end piece comprises a rectangular block attached at an end of the cylindrical pipe, wherein the movable contact assembly comprises a movable main contact and the movable arcing contact, wherein the movable main contact is for engaging with the fixed main contact for current conduction, and the movable arcing contact is for the bus transfer switching, wherein the movable main contact is provided on the rectangular block, and the movable arcing contact is provided at the end of the cylindrical pipe on a portion about a periphery of the cylindrical pipe, wherein during engagement of the movable contact assembly with the fixed contact assembly, the cylindrical pipe turns about a first axis to bring the movable contact assembly proximal to the fixed contact assembly, and then twists about a second axis for engagement of the movable main contact with the fixed main contact, wherein during the engagement of the movable contact assembly and fixed contact assembly, the fixed arcing contact and the movable arcing contact for bus transfer switching are contacts that are first to engage and are disengaged when the movable main contact and the fixed main contact are engaged.

10. The contact system of claim 9, wherein the fixed main contact comprises a first set of contact fingers and a second set of contact fingers, wherein the fixed arcing contact is located proximal to the first set of contact fingers, and wherein a separation between the first set of contact fingers and the second set of contact fingers is less than a separation between the fixed arcing contact and the second set of contact fingers.

11. The contact system of claim 10, wherein the contacting element of the fixed arcing contact is provided on a portion of a finger that is at an angle to the first set of contact fingers.

12. The contact system of claim 10, wherein the movable main contact comprises two c-shaped contacting elements attached with the rectangular block, wherein each c-shaped contacting element is provided for engagement with a corresponding set of contact fingers.

13. The contact system of claim 9, wherein the fixed contact assembly further comprises a mechanical stopper for stopping a turning movement of the current path pipe.

14. The contact system of claim 9, wherein the movable contact assembly further comprises a stopper bolt attached with the rectangular block, for a separation of the finger of the fixed contact assembly from the main movable contact of the movable contact assembly during short circuit condition.

15. The contact system of claim 9, wherein a length and breadth of the end piece is less than a diameter of the current path pipe.

16. The contact system of claim 9, wherein the switchgear comprises a double side break disconnector with two movable contacts and two fixed contacts.

17. A switchgear having a turn and twist mechanism for electrical connection and disconnection, the switchgear comprising a contact system for electrical current conduction and bus transfer switching, the contact system comprising:

a fixed contact assembly including a fixed main contact and a fixed arcing contact for the bus transfer switching, wherein the fixed arcing contact comprises a finger including a contacting element for engaging with a corresponding contacting element of a movable arcing contact of the contact system during the bus transfer switching; and a movable contact assembly comprising a current path pipe and an end piece, wherein the current path pipe comprises a cylindrical pipe and the end piece comprises a rectangular block attached at an end of the cylindrical pipe, wherein the movable contact assembly comprises a movable main contact and the movable arcing contact, wherein the movable main contact is for engaging with the fixed main contact for current conduction, and the movable arcing contact is for the bus transfer switching, wherein the movable main contact is provided on the rectangular block, and the movable arcing contact is provided at the end of the cylindrical pipe on a portion about a periphery of the cylindrical pipe;

wherein during engagement of the movable contact assembly with the fixed contact assembly, the cylindrical pipe turns about a first axis to bring the movable contact assembly proximal to the fixed contact assembly, and then twists about a second axis for engagement of the movable main contact with the fixed main contact, wherein during the engagement of the movable contact assembly and the fixed contact assembly, the fixed arcing contact and the movable arcing contact for the bus transfer switching are contacts that are first to engage and are disengaged when the movable main contact and the fixed main contact are engaged; and wherein the fixed contact assembly further comprises a mechanical stopper for stopping a turning movement of the current path pipe.

18. The switchgear of claim 17, wherein the fixed main contact comprises a first set of contact fingers and a second set of contact fingers, wherein the fixed arcing contact is located proximal to the first set of contact fingers, and wherein a separation between the first set of contact fingers and the second set of contact fingers is less than a separation between the fixed arcing contact and the second set of contact fingers.

19. The switchgear of claim 18, wherein the contacting element of the fixed arcing contact is provided on a portion of a finger that is at an angle to the first set of contact fingers.

20. The switchgear of claim 18, wherein the movable main contact comprises two c-shaped contacting elements attached with the rectangular block, wherein each c-shaped contacting element is provided for engagement with a corresponding set of contact fingers.

* * * * *